United States Patent [19]

Comley

[11] Patent Number: 4,649,659

[45] Date of Patent: Mar. 17, 1987

[54] OBTURATION IN A FIREARM

[75] Inventor: Jack W. Comley, Cheshunt, England

[73] Assignee: Royal Ordnance plc, London, England

[21] Appl. No.: 743,819

[22] Filed: Jun. 12, 1985

[30] Foreign Application Priority Data

Jun. 15, 1984 [GB] United Kingdom ..... 8415319

[51] Int. Cl.[4] ..... F41C 3/00; F41F 1/00

[52] U.S. Cl. ..... 42/2; 42/106

[58] Field of Search ..... 42/1 R, 1 Z, 1 L, 1 G, 42/1 M, 2, 1 H, 1 F, 39.5, 10

[56] References Cited

U.S. PATENT DOCUMENTS

| | | | |
|---|---|---|---|
| 398,595 | 2/1889 | Emmens | 42/10 |
| 2,102,199 | 12/1937 | Dixon | 42/10 |
| 2,966,827 | 1/1961 | Harvey | 89/1.7 |
| 3,270,455 | 9/1966 | Smernoff et al. | 42/1 Z |

FOREIGN PATENT DOCUMENTS

| | | | |
|---|---|---|---|
| 270872 | 12/1950 | Fed. Rep. of Germany . | |
| 524185 | 7/1940 | United Kingdom | 42/10 |

*Primary Examiner*—Deborah L. Kyle

*Assistant Examiner*—Michael J. Carone

*Attorney, Agent, or Firm*—William R. Hinds

[57] ABSTRACT

A riot control weapon comprises a barrel, a fixed breech block, and there-between a chamber having a loading aperture through which a cylindrical round of ammunition can be inserted and ejected, the round being insertable by firstly a translational movement to bring the forward end of the round into the chamber, and secondly a rotational movement during which the round is pivoted until the round is fully chambered in alignment with the barrel, and wherein the chamber is provided with an obturating surface which extends continuously from a point adjacent the forward end of the chamber adjacent the loading aperture, rearwardly and away from the loading aperture to complete a closed loop within a cylindrical surface internally of the chamber, whereby the said rotational movement brings the round into sealing contact with the obturating surface around a complete loop.

In a preferred embodiment there is provided a stop adjacent the forward end of the chamber, the round coming into contact with the stop at the end of the said translational movement, and the stop acting as a pivotal point for the said rotational movement.

1 Claim, 2 Drawing Figures

OBTURATION IN A FIREARM

Figure 1:
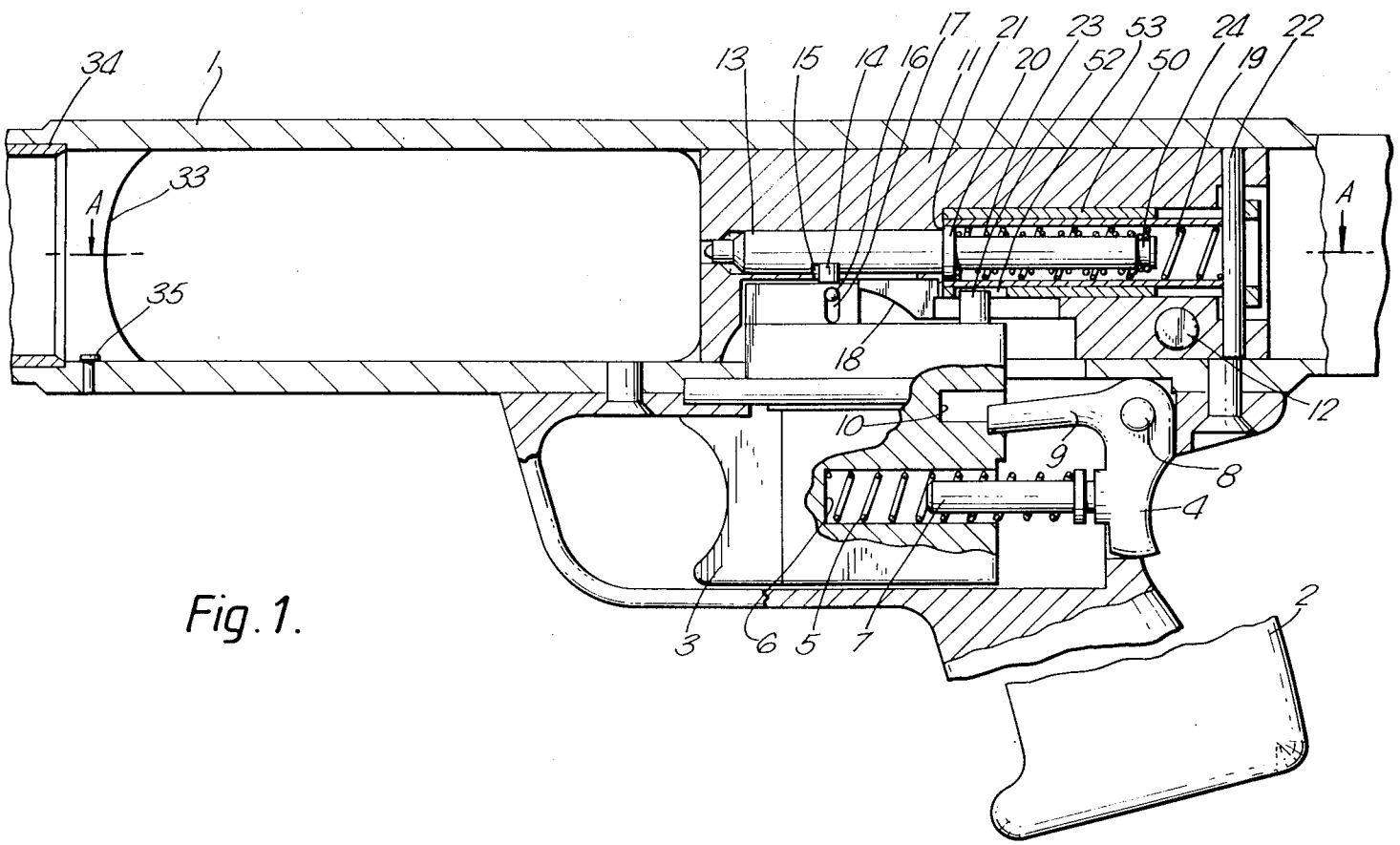

This invention relates to firearms, especially those of relatively large calibre for firing riot control rounds. Firearms for this purpose are in wide use, and conventionally have a break action, that is to say the barrel pivots relative to the breech so as to permit removal of the case of a spent round, and subsequent insertion of a further round into a chamber which provides support for the case against the large pressures generated on firing. The barrel is then pivoted back into place and locked so that the breech remains closed on firing.

This reloading action is both lengthy and awkward, and can leave the user exposed to attack for a critical period of time. Furthermore, it requires a degree of co-ordination which a user may find difficult to achieve during times of mental stress, ie when under attack. There is therefore a need for a firearm for these relatively large calibre anti-riot rounds, which is capable of being prepared for repeat firings with maximum ease and as quickly as possible.

The Applicant has proposed firearms which can meet the criterion by means of an automatic action incorporating a moving breech block, but a single-shot action would retain the advantage of simplicity of construction, and would be correspondingly less expensive. There thus exists a need for an anti-riot weapon having a single shot action, but capable of more rapid ejection and re-loading than has been found possible hitherto. The present invention seeks to fulfill the requirement by the provision of a firearm designed to fire a round with the case virtually unsupported at the moment of firing. This is made possible by the realisation that a riot control round requires a reduced quantity of propellant explosive, since the anti-riot projectile is fired with less energy than a "kill" round. The case can thus quite easily be made strong enough to be self supporting.

According to the present invention there is provided a riot control weapon comprising a barrel, a fixed breech block, and therebetween a chamber having a loading aperture through which a cylindrical round of ammunition can be inserted and ejected, the round being insertable by firstly a translational movement to bring the forward end of the round into the chamber, and secondly a rotational movement during which the round is pivoted until the round is fully chambered in alignment with the barrel, and wherein the chamber is provided with an obturating surface which extends continuously from a point adjacent the forward end of the chamber adjacent the loading aperture, rearwardly and away from the loading aperture to complete a closed loop within a cylindrical surface internally of the chamber, whereby the said rotational movement brings the round into sealing contact with the obturating surface around a complete loop.

In a preferred embodiment there is provided a stop adjacent the forward end of the chamber, the round coming into contact with the stop at the end of the said translational movement, and the stop acting as a pivotal point for the said rotational movement.

There is preferably provided a further stop adjacent the forward end of the chamber on the side thereof remote from the loading aperture, whereby the round pivots about the further stop during the final part of the said rotational movement thereby to be closely constrained against the forward face of the breech block.

Conveniently the chamber is of essentially cylindrical form but provided with clearances to permit the said translational and rotational movements to occur, the said obturating surface passing to the rear of the said clearances.

Figure 2:
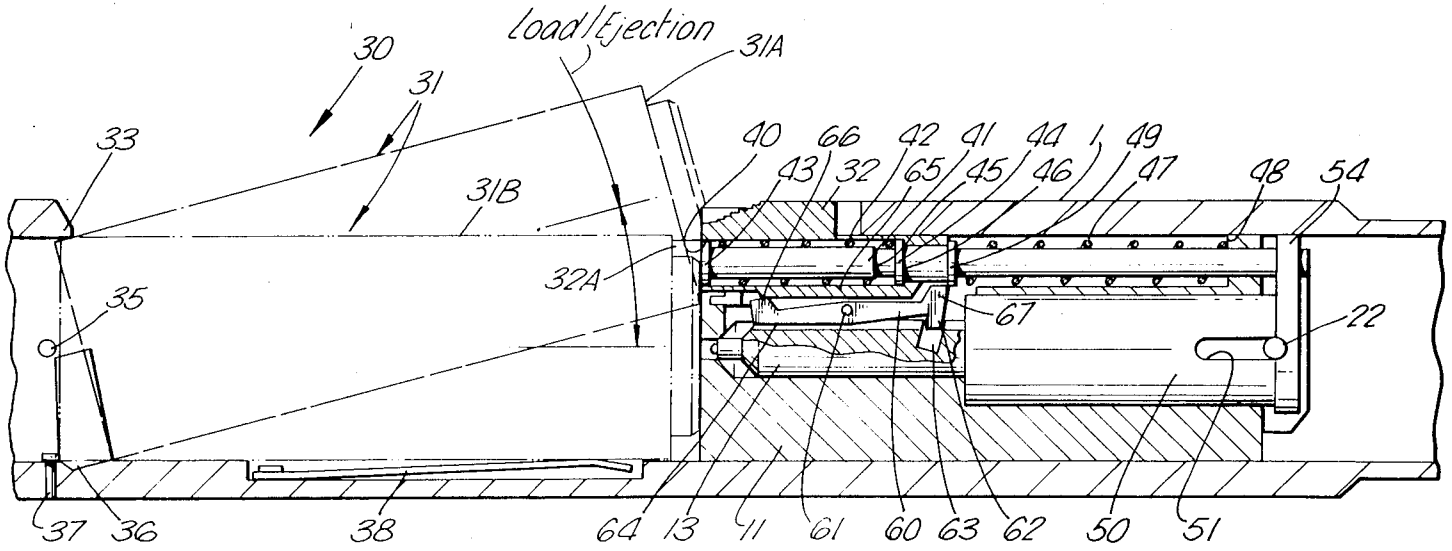

The invention will now be described by way of example only with reference to the accompanying drawings, of which FIG. 1 is a sectional transverse view showing the mechanism of a weapon in accordance with the invention, and FIG. 2 is a sectional view on the plane A—A of FIG. 1.

As shown in FIGS. 1 and 2, a single-shot firearm primarily intended for large-calibre ammunition comprises a tubular body 1 and a pistol grip 2. Longitudinally slideable within the pistol grip 2 under the body 1 is a trigger 3 provided with a safety catch 4. The safety catch and trigger are biased apart by means of a spring 5 received within a recess 6 in the trigger and containing a guide pin 7. The safety catch is pivoted to the body 1 at 8, and has a nose 9 which can enter a recess 10 in the trigger only when rotated against the bias of the spring 5. At other times, the nose rests against a surface of the trigger to prevent its operation. The trigger can be actuated by squeezing the safety catch and trigger together, so that the safety catch is rotated, the nose 9 aligns with the recess 10, and the trigger is freed to move, opposed by the bias of the spring 5.

Within the body 1 there is located a breech block 11 which is held in place in the body by means of a transverse retaining pin 12. Slideable longitudinally within the breech block 11 is a firing pin 13. The firing pin and the trigger are mechanically interconnected by means of an actuating pin 14 which is slideable vertically (as viewed in FIG. 1) within a bore in an upwardly extending portion of the trigger 3. The actuating pin 14 is upwardly biased (as viewed in FIG. 1) into engagement with a recess 15 in the underside of the firing pin by means of a spring (not shown). Rigidly fixed to the actuating pin 14 is a cross-pin 16 which projects at each side of the actuating pin 14 into vertically elongate slots 17 formed in the aforesaid upwardly extending portion of the trigger. The cross-pin 16 rides on a cam surface 18 of the breech block 11.

Rearward motion of the firing pin 13 relative to the breech block 11, beyond the equilibrium rest position illustrated is resiliently opposed by a spring 19 constrained between a washer 20 which abuts a shoulder 21 on the firing pin and a transverse retaining pin 22 received in the breech block 11. Forward motion of the firing pin beyond the equilibrium position is opposed by a spring 23 constrained at its forward end by the washer 20 and at its rearward end by being received in an annular groove 24 of the firing pin.

When the trigger 3 is actuated, the firing pin 13 is drawn back by the actuating pin 14 thus compressing the spring 19. At the same time, the cross pin 16 rides downwardly on the cam surface 18 until it has pulled the retaining pin 14 clear of the recess 15, thus releasing the firing pin. The firing pin therefore flies forward under the action of spring 19, and continues under its own inertia beyond the equilibrium position, now opposed by the spring 23, to project momentarily beyond the forward face of the breech block, and thus to fire any round of ammunition which may be in place. Thereafter, the firing pin is withdrawn to its equilibrium position by the spring 23.

As shown in FIG. 2, a round of ammunition 31 (shown in two positions in outline—partially (31A) and fully (31B) inserted), may be loaded or ejected through an aperture 30 in the side of the body 1. When loaded, the round is retained in position by a catch 32 as explained hereinafter.

The round 31 is slightly longer than the aperture 30, and it is therefore inserted first in a downwardly angled orientation (31A) so that a forward edge engages under a rim 33 of the rearward end of the barrel 34. In this orientation, the round is moved forwardly until it engages a stop 35 carried by the body 1, and a cut-away 36 is formed in the body 1 to permit this movement.

The round 31 is now pivoted bodily about the stop 35 towards the position 31B, and because its forward edge is below (as viewed in FIG. 2) the centreline of the tubular body 1, it is necessary to provide further cutaways (not shown) on each side of the body 1 as dictated by geometric considerations to enable this movement to take place. As the round nears its fully located position (31B), its lower (as seen in FIG. 2) forward edge engages a further stop 37, and the final movement is a pivotal movement of the round about this stop. The round is by this means brought to a position where it is held firmly against only the slightest longitudinal movement between the stop 37 and the forward face of the fixed breech block 11. The entry of the round to the position is opposed by a single leaf spring 38, received within a recess. The spring 38 provides the spring energy for eventual ejection. Ejection is, however, prevented by the spring biased catch 32.

The firearm is designed for use with ammunition having a case which is self-supporting on firing, and the need for it to enter a supporting chamber is thus obviated. However, it is still, of course, necessary to provide obturation between the casing and the barrel. This done by providing an obturating surface which extends symmetrically under the lip 33. The form of the obturating surface is essentially as follows, with reference to FIG. 2. From the uppermost point of the lip 33, the surface extends downwardly through just less than 90° of arc in the transverse plane of the lip on each side of the barrel. From these points, it extends rearwardly above the aforesaid further cutaways on each side of the barrel, and then downwardly and forwardly to complete the seal forwardly of the spring recess. A complete circumferential seal is thereby obtained in such a way that the round 31 can be inserted and rotated without obstruction by the obturating surface, adequate obturation nevertheless being obtained when the round reaches the final position 31B and thus contacts the obturating surface around an unbroken circumferential line.

As noted, the round is retained in position 31B by means of a nose 32A of a spring-loaded catch 32. The loading catch 32 is provided with a longitudinal bore 40 within which there is slideable a catch operating rod 41. Within the bore 40 and surrounding the rod 41 is a spring 42 which is captive between a forward shoulder 43 on the rod 41, and a split clip 44 slideable between spaced shoulders 45, 46 on the rod 41. The spring 42 resiliently opposes forward motion of the catch 32 relative to the rod 41 from the equilibrium position illustrated.

Surrounding a rearward extension of the rod 41 and located within a longitudinal bore in the breech block 11 is a spring 47 which is captive between a shoulder 48 on the breech block, and a washer 49 abutting a rear end of the catch 32 and slideable on the said rearward extension. The spring 47 resiliently opposes rearward motion of the catch relative to the breech block 11 from the equilibrium position illustrated.

The rod 41 is provided with an annular recess rear its rear end which is engaged by a hooked arm 54 carried by a catch operating tube 50 slideable longitudinally within the breech block 11. The pin 22 passes through longitudinal slots 51 to enable this longitudinal sliding movement. The trigger carries an upstanding pin 52 which engages in a slot 53 in the catch operating tube 50, which can thus be moved longitudinally by actuation of the trigger.

In order to ensure that a round of ammunition cannot inadvertently escape before the firing cycle is completed, there is provided a delay catch 60 pivoted to the breech block 11 at 61. The delay catch is provided with a tail 62 which is downwardly directed (as viewed in FIG. 2), and which can enter a corresponding slot 63 in the firing pin 13. The firing pin is also provided with a groove 64 extending along its length, which can partially accommodate the delay catch 60. The catch 32 is provided with a projection 65 which can interact with a forward tongue 66 and a rearward tongue 67 on the delay catch 60.

In the condition as illustrated in which actuation of the trigger has not commenced, the tail 62 can enter the recess 63. The loading catch 32 is resiliently biased into the position illustrated in which a round of ammunition 31B is retained in place ready to fire, against the bias of the ejection spring 38. However, the catch 32 can be moved rearwardly against its spring bias, and when the projection 65 comes against the tongue 67, the delay catch 60 can pivot to permit clearance, so that a fresh round of ammunition can be inserted or manually ejected via the opening 30.

When the trigger is actuated, in its initial movement it carries with it the firing pin 13. The tail 62 and recess 63 thus become misaligned, and any attempt at manual movement of the loading catch 32 will be prevented by the projection 65 coming into contact with the tongue 67. Ejection of the round is thus prevented.

On further rearward movement of the trigger, the pin 52 engages the catch operating tube 50 and draws it rearwardly, together with the catch operating rod 41. The catch 32 is not free to move, and so spring energy tending to move the catch 32 rearwards is stored in the spring 42.

Continued movement of the trigger results in release of the firing pin 13 as hereinbefore described, and the round 31B is fired, relative movement between the firing pin 13 and the delay catch 60 being facilitated by the groove 64. During its forward movement, the firing pin moves with sufficient speed for the tail 62 to jump the recess 63, but after firing the firing pin comes back, under the influence of the spring 24, to a position where tail 62 and recess 63 are aligned.

Only at this stage is the delay catch 60 freed to pivot, and the loading catch 32 is thus freed to be retracted under the influence of the spring 47. There still remains substantial residual pressure of gas within the spent case, however, and it is essential for safety to ensure that the case cannot eject until this pressure has been sufficiently dissipated.

The firearm relies upon harnessing this residual pressure itself to prevent premature ejection, and the design is based upon the realisation that the residual pressure has the effect of loading the spent case rearwardly against the breech block. Hence friction between the casing and the breech block resists ejection under the influence of the spring 38.

The spring 38 may for example exert a load of about 3 lb tending to eject the case. With a rearward area of say 2 sq in, and assuming a coefficient of friction of about 10%, the round will thus be ejected only when the residual pressure falls to about 1 bar (15 psi).

A particular advantage of the ejection mechanism described is that ejection of the spent round is completely automatic in that no action whatever is required of the user once the trigger has been pulled to fire the weapon. In particular, the user does not even need to release the trigger as with prior art firearms. This can be of especial importance during active use of the firearm, especially for riot control, where the user can be under considerable stress and can easily make an elementary mistake such as attempting to load a further round before ejecting the spent round. Speed of reloading may be of the essence in order to ensure the operator's own safety—but this very consideration may impair his actions to the point where he forgets to release the trigger after firing, and then panics because insertion of a fresh round is obstructed by the previously spent case.

I claim:

1. A firearm for large calibre ammunition comprising a body having a longitudinal axis, and a forward end and a rearward end spaced apart on said axis;

a barrel fixed in relation to the body at the forward end of the body;

a breech block fixed in relation to the body and rearwardly of the barrel;

said body defining a chamber having a surface of substantially cylindrical form;

said chamber being located between said barrel and said breech block and having a length and a diameter;

said body further defining a longitudinally-extending loading aperture of a length less than that of the chamber;

said chamber being provided adjacent its forward end and diametrically opposite to the loading aperture with relieved portions which enlarge its cylindrical form;

said firearm further comprising a first stop spaced forwardly of the chamber and circumferentially intermediate the loading aperture and the said relieved portions;

said firearm further comprising a second stop at the forward end of the chamber and diametrically opposite to the loading aperture; said first and second stops projecting radially inwardly of the said cylindrical surface;

and the cylindrical surface extending uninterruptedly from a point adjacent the loading aperture and forward thereof, and rearwardly between the loading aperture and the said relieved portions to complete an obturating surface forming a part of the said cylindrical surface and in the form of a closed loop around the inner circumference of the chamber, the construction and arrangement being such that a cylindrical round of ammunition having a length equal to that of the chamber and a calibre appropriate to the chamber diameter is insertable into the chamber through the loading aperture by firstly a translational movement to bring the end of the round against the first stop, secondly a rotational movement about the first stop as pivot point, and thirdly a rotational movement about the second stop as pivot point, thereby to bring the round finally into sealing contact with the said obturating surface and held against longitudinal movement between the breech block and the second stop, the said relieved portions providing the necessary clearance to permit insertion of the said round of ammunition.

* * * * *